US006997829B2

(12) United States Patent
Kennedy, III et al.

(10) Patent No.: US 6,997,829 B2
(45) **Date of Patent: *Feb. 14, 2006**

(54) SPORT BALL WITH SELF-CONTAINED DUAL ACTION INFLATION MECHANISM

(75) Inventors: Thomas J. Kennedy, III, Wilbraham, MA (US); Mark A. Cloutier, Wilbraham, MA (US)

(73) Assignee: Russell Asset Management, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/726,950

(22) Filed: Dec. 3, 2003

(65) Prior Publication Data

US 2004/0198147 A1 Oct. 7, 2004

Related U.S. Application Data

(60) Provisional application No. 60/435,222, filed on Dec. 20, 2002.

(51) Int. Cl.
*A63B 37/00* (2006.01)

(52) U.S. Cl. ..... 473/593

(58) Field of Classification Search ..... 473/593, 473/610, 611; 446/220, 224; 417/478, 479, 417/488, 259, 526, 527; 36/29
See application file for complete search history.

(56) References Cited

U.S. PATENT DOCUMENTS

| | | | |
|---|---|---|---|
| 602,294 | A | 4/1898 | Arnold |
| 3,119,617 | A | 1/1964 | Topper |
| 3,229,976 | A | 1/1966 | Allen, Jr. |
| 4,595,200 | A | 6/1986 | Shishido |
| 4,775,589 | A | 10/1988 | Hamada et al. |
| 4,975,028 | A | 12/1990 | Schultz |
| 5,098,095 | A | 3/1992 | Weiss |
| 5,238,244 | A | 8/1993 | Cotter et al. |
| 5,494,410 | A | 2/1996 | Maier-Laxhuber et al. |
| 6,287,225 | B1 | 9/2001 | Touhey et al. |
| 6,491,595 | B1 | 12/2002 | Feeney et al. |
| 2002/0187866 | A1 | 12/2002 | Touhey et al. |

FOREIGN PATENT DOCUMENTS

| | | |
|---|---|---|
| WO | WO 01/83048 | 8/2001 |
| WO | WO 02/060541 | 8/2002 |

*Primary Examiner*—Steven Wong

(57) ABSTRACT

An inflatable sport ball, such as a basketball, a football, a soccer ball, a volleyball or a playground ball, is provided with a self-contained inflation mechanism, or multiple self-contained inflation mechanisms, for inflating or adding pressure to the ball. The mechanism is a pump which is positioned and retained inside of the ball and which is operable from outside of the ball to pump ambient air into the ball. The pump is a dual action pump allowing air to be added to the ball on both a forward stroke and a reverse stroke.

27 Claims, 12 Drawing Sheets

SPORT BALL WITH SELF-CONTAINED DUAL ACTION INFLATION MECHANISM

The present invention claims priority to U.S. Provisional Patent Application Ser. No. 60/435,222 filed on Dec. 20, 2002.

FIELD OF THE INVENTION

The present invention relates to sport or game balls that contain integral mechanisms for inflating or adding pressure to the balls. The inflation mechanisms are double action pumps instead of the single action pumps currently available in certain inflatable sport balls.

BACKGROUND OF THE INVENTION

Conventional inflatable sport balls, such as basketballs, footballs, soccer balls, volleyballs and playground balls, are inflated through a traditional inflation valve using a separate inflation needle that is inserted into and through a self-sealing inflation valve on the ball. A separate pump, such as a traditional bicycle pump, is connected to the inflation needle and the ball is inflated using the pump. The inflation needle is then withdrawn from the inflation valve which then self-seals to maintain the air pressure within the ball. This system works fine until the ball needs inflation or a pressure increase and a needle and/or pump are not readily available.

More recently, inflatable sport balls have been developed that have integral pumps, but these pumps are only single action pumps. If a relatively large pressure increase is needed, it can be quite time consuming to add air and increase the ball's pressure. This is because the pumps are small and do not add a large volume of air with each stroke.

SUMMARY OF THE INVENTION

An object of the present invention is to inflate or add pressure to a sport ball without the need for separate inflation equipment such as a separate inflation needle and pump, and to be able to add the air more quickly by reducing the number of strokes otherwise needed.

The present invention provides a sport ball having a self-contained dual action inflation mechanism. The invention also provides a ball having multiple self-contained inflation mechanisms, in which at least one of the inflation mechanisms is of the dual action type. As used herein, a "dual action" or "double action" pump or inflation mechanism refers to a pump that adds air on both the in (or down) stroke and the out (or up) stroke. Restated, the dual action pump introduces air to the ball in both directions of the pumping action.

More specifically, the invention relates to a sport ball that has at least one self-contained pump device which is operable from outside the ball and which pumps ambient air into the ball to achieve a desired pressure. Additionally, the pump is a double action or dual action pump. The dual action of the pump allows air to be introduced into the interior of the inflatable sport ball on both the forward stroke and the reverse stroke by drawing air into separate chambers on each stroke. The dual action pump will be described in more detail below. The pump mechanism may also have a pressure relief mechanism and/or a pressure indication device.

In a first aspect, the present invention provides a sport ball having an integral pump. The ball comprises a flexible hall, body adapted to retain pressurized air. The body also defines an aperture. The ball additionally comprises a pump disposed in the aperture and retained within the ball body. The pump includes a cylinder, a piston disposed in the cylinder, and a valve assembly configured to introduce air into the ball body upon movement of the piston from an extended position to an inserted position. The valve assembly is also configured to introduce air into the ball body upon movement of the piston from the inserted position to the extended position.

In another aspect, the present invention provides an inflatable ball having an integral dual action pump assembly for changing air pressure within the ball. The ball comprises a rubber bladder defining an interior region adapted for retaining pressurized air. The ball also comprises an outer layer disposed about the rubber bladder. And, the ball comprises a pump assembly disposed in the interior region of the rubber bladder. The pump assembly includes a movable plunger sealingly disposed within a cylinder secured to the rubber bladder. The plunger is movable in both a forward stroke and a reverse stroke. The pump assembly is adapted to transfer air to the interior region of the rubber bladder by moving the plunger in either of the forward stroke or the reverse stroke.

In yet another aspect, the present invention provides an inflatable sport ball having an integral dual-action pump assembly for changing air pressure within the ball. The ball comprises a ball carcass which defines an interior region for retaining air at a pressure greater than atmospheric pressure. The carcass defines an aperture between the interior region and the exterior of the ball. The ball also comprises a pump assembly disposed within the aperture and extending into the interior region. The pump assembly comprises a pump cylinder including an open end, a nozzle end, and a cylindrical sidewall extending between the open end and the nozzle end. The cylinder defines a generally hollow interior. The pump assembly also comprises a pump plunger having a cap end, a sealing end, and a tubular wall extending between the cap end and the sealing end. The plunger defines a generally hollow interior accessible from the sealing end. The plunger is movably disposed within the hollow interior of the cylinder between a forward position at which the sealing end of the plunger is proximate the nozzle end of the cylinder, and a reverse position at which the sealing end of the plunger is proximate the open end of the cylinder. Air is transferred into the interior region of the ball carcass upon movement of the plunger from the forward position to the reverse position or from the reverse position to the forward position.

In yet another aspect, the present invention provides a dual action pump adapted for incorporation in an inflatable sport ball. The pump comprises a cylinder having a head end, a nozzle end, and a cylindrical sidewall extending therebetween. The sidewall has an exterior surface and an oppositely directed interior surface. The cylinder defines a generally hollow interior chamber accessible from the head end and the nozzle end. The pump also comprises a movable plunger disposed in the hollow interior chamber of the cylinder. The plunger has a cap end, a sealing end, and a tubular wall extending therebetween. The plunger defines a hollow interior region accessible from the sealing end. The pump also comprises an air transfer tube extending within both the hollow interior chamber of the cylinder and the hollow interior region of the plunger. The air transfer tube is secured to the nozzle end of the cylinder.

These and other objects and features of the invention will become apparent from the specification, drawings and claims.

BRIEF DESCRIPTION OF THE DRAWINGS

The following is a brief description of the drawings, which is presented for the purposes of illustrating the invention and not for the purposes of limiting the same.

DESCRIPTION OF THE PREFERRED EMBODIMENTS

The present invention relates to a sport or game ball having an integral dual action pump. The pump is retained within the ball and may be easily used to introduce air into the ball and thereby inflate the ball.

The pump preferably comprises three components, a cylinder, a piston disposed in the cylinder, and a valve assembly. The piston is movable within the cylinder between an extended position and an inserted position. The valve assembly includes a plurality of valves, described in greater detail herein, that enable air to be admitted into the ball during each direction of movement of the piston. That is, air is introduced into the ball during movement of the piston from an extended position to an inserted position. And, air is introduced into the ball during movement of the piston from the inserted position to the extended position. Furthermore, it is not necessary that the piston be displaced along the entire stroke length, i.e. between a fully extended position and a fully inserted position or vice versa. The unique pump of the present invention delivers air to the ball during movement in either direction of the piston. It will be appreciated however that some minimum or threshold degree of piston travel in either direction may be necessary to achieve a sufficient pressure to cause air to enter the ball.

Figure 1:
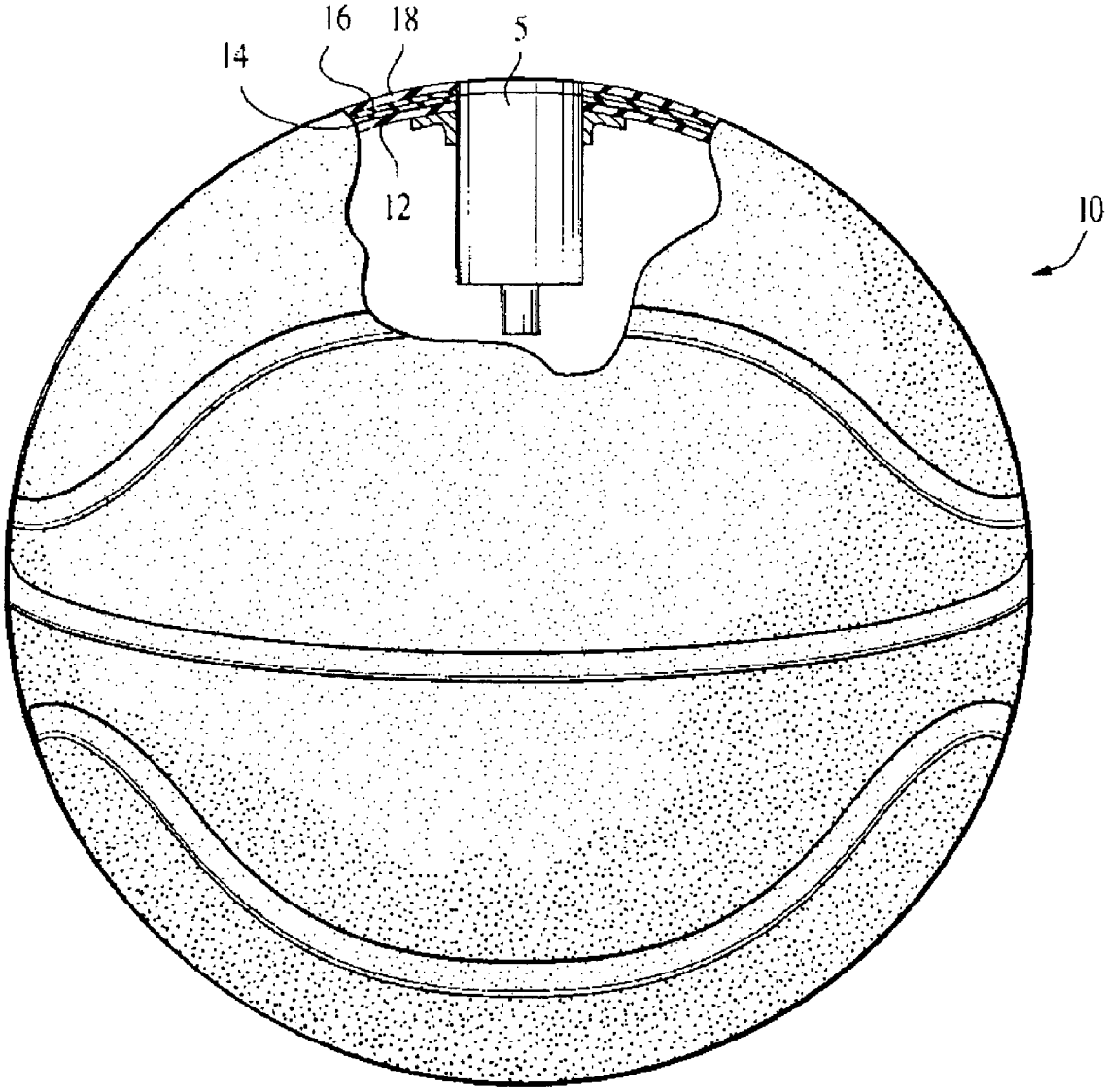
FIG. 1 is a partial cross-sectional view of a basketball utilizing a preferred embodiment dual action, pump in accordance with the present invention.

Referring to FIG. 1 of the drawings, a sport ball 10 is illustrated incorporating a preferred embodiment inflation pump 5 of the invention. The ball which is illustrated is one typical basketball construction comprising a carcass having a rubber bladder 12 for air retention, a layer 14 composed of layers of nylon or polyester yarn windings wrapped around the bladder 12 and an outer rubber layer 16. As will be understood, "carcass" refers to the flexible body of the ball. For a laminated ball, an additional outer layer 18 of leather or a synthetic material may be used which preferably comprises panels that are applied by adhesive and set by cold molding to the rubber layer 16. The windings 14 are randomly oriented and two or three layers thick, and they form a layer that cannot be extended to any significant degree. The layer formed by the windings 14 also restricts the ball 10 from expanding to any significant extent beyond its regulation size when inflated beyond its normal playing pressure. This layer 14 for footballs, volleyballs and soccer balls is referred to as a lining layer and is usually composed of cotton or polyester cloth that is impregnated with a flexible binder resin such as vinyl or latex rubber. The outer layer 18 may be stitched for some sport balls, such as a soccer ball or a volleyball. The outer layer may optionally have a foam layer backing or a separate foam layer.

Figure 2:
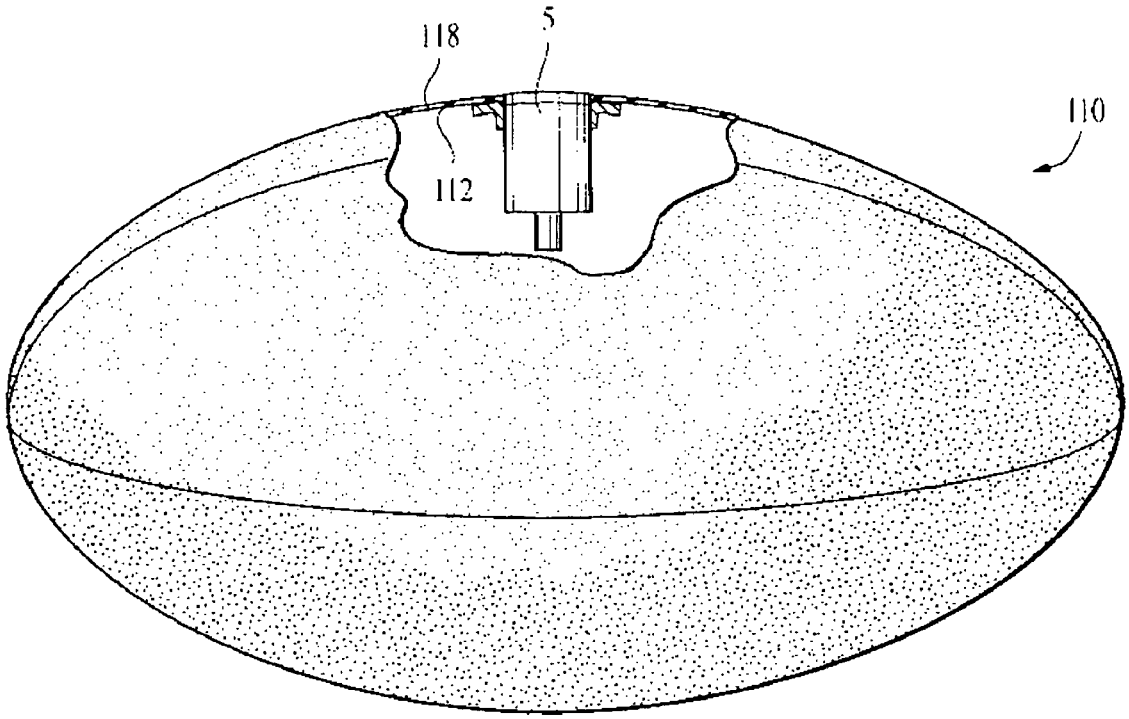
FIG. 2 is a partial cross-sectional view of a football utilizing the preferred embodiment dual action pump in accordance with the present invention.

FIG. 2 illustrates a football 110 incorporating an inflation pump 5 according to the present invention. The football 110 comprises a carcass having a rubber bladder 112 for air retention, and an outer layer 118 of leather or synthetic material. As will be appreciated, the carcass of the football 110 may include one or more additional layers such as a winding layer or reinforcement layer, a foam or backing layer, and a secondary rubber lining layer.

Other sport ball constructions, such as sport balls produced by a molding process, such as blow molding, may also be used in the invention. For an example of a process for molding sport balls, see, for example, U.S. Pat. No. 6,261,400, incorporated herein by reference.

Materials suitable for use as the bladder include, but are not limited to, butyl, latex, urethane, and other rubber materials generally known in the art. Examples of materials suitable for the winding layer include, but are not limited to, nylon, polyester and the like. Examples of materials suitable for use as the outer layer, or cover, include, but are not limited to, polyurethanes, including thermoplastic polyurethanes; polyvinylchloride (PVC); leather; synthetic leather; and composite leather. Materials suitable for use as the optional foam layer include, but are not limited to, neoprene, SBR, TPE, EVA, or any foam capable of high or low energy absorption. Examples of commercially available high or low energy absorbing foams include the CONFOR™ open-celled polyurethane foams available from Aearo EAR Specialty composites, Inc., and NEOPRENE™ (polychloroprene) foams available from Dupont Dow Elastomers.

Figure 3:
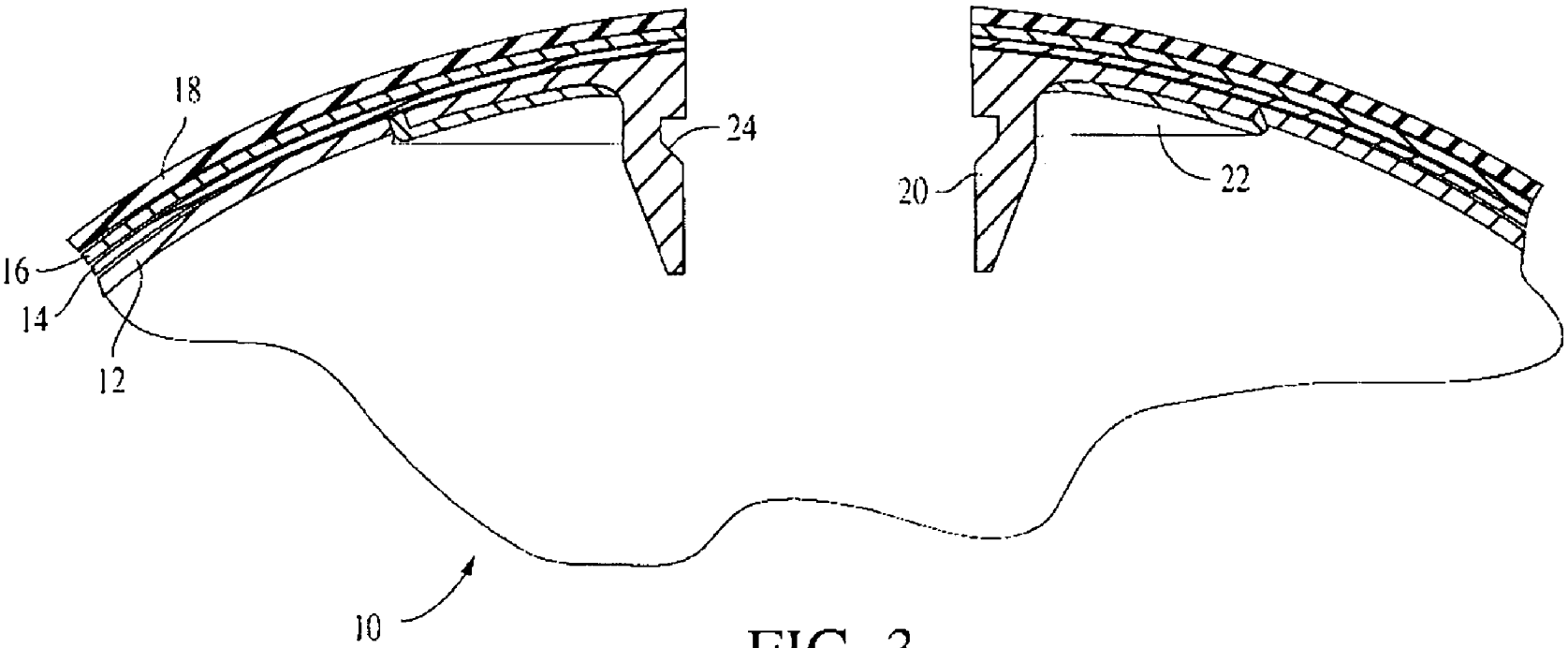
FIG. 3 is a detailed cross-sectional view of a portion of the basketball depicted in FIG. 1 illustrating a preferred mounting configuration for the dual action pump of the present invention.

Referring to FIG. 3, incorporated into the carcass of the ball 10 of the invention during its formation is a rubber pump boot or housing 20 that defines a central opening and an outwardly extending flange 22 which is preferably bonded to the bladder 12 using a rubber adhesive. The boot 20 is preferably located between the rubber bladder 12 and the layer of windings 14. The boot 20 may be constructed of any suitable material, such as butyl rubber, natural rubber, urethane rubber, or any suitable elastomer or rubber material known in the art, or combinations thereof. A molding plug (not shown) is inserted into the boot opening during the molding and winding process to maintain the proper shape of the central opening and to allow the bladder 12 to be inflated during the manufacturing process. The molding plug is preferably aluminum, composite or rubber, and most preferably aluminum. The central opening defined through the boot 20 is configured with a groove 24 to retain a flange extending from the upper end of a pump cylinder described and illustrated later herein. The pump cylinder can optionally be bonded to the boot 20 using any suitable flexible adhesive (epoxy, urethane, cyanoacrylate, or any other flexible adhesive known in the art).

Figure 4:
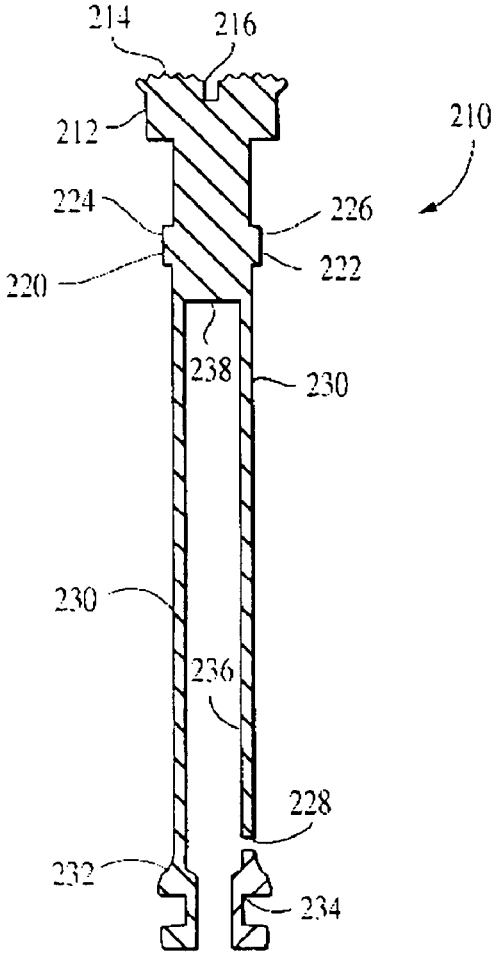
FIG. 4 is a detailed schematic view of a plunger component of the preferred embodiment dual action pump.
Figure 5:
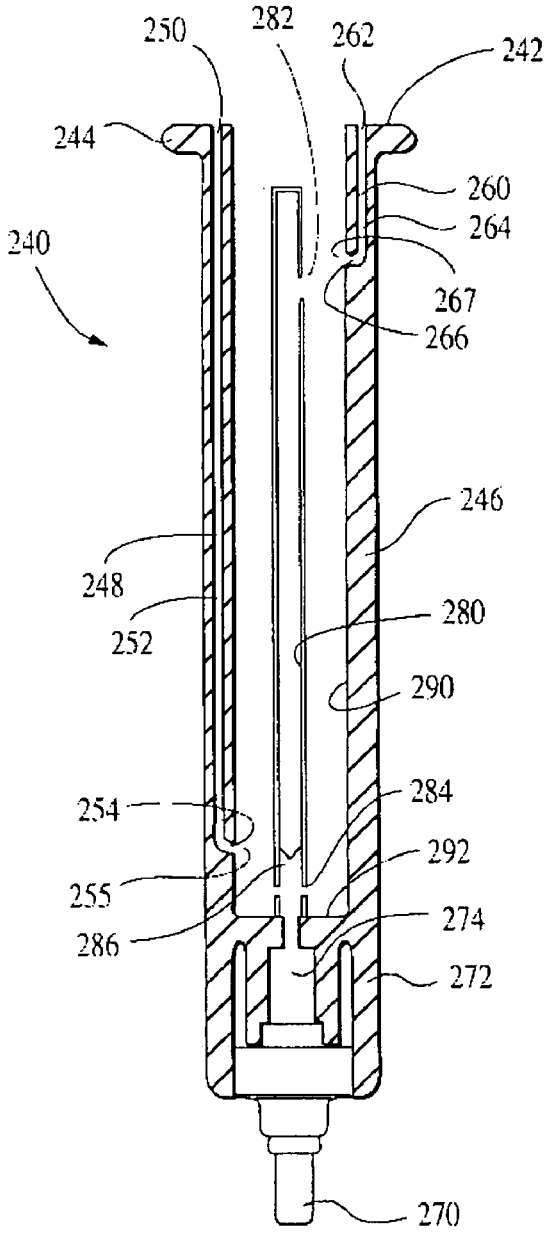
FIG. 5 is a detailed schematic view of a pump cylinder component of the preferred embodiment dual action pump.

Referring to FIGS. 4 and 5, the preferred embodiment dual action pump according to the present invention comprises a plunger 210 and a pump cylinder 240. The pump cylinder 240 shown is a right cylinder, but other cylinders that are not right cylinders, such as a cylinder having a non-circular cross-section, may be used. Specifically, referring to FIG. 4, the plunger 210 includes a plunger body 220 having a cap 212 defined or formed on one end, and a tubular wall 230 extending from the body 220 away from the cap 212. The cap 212 defines an outer face 214 and a longitudinal recessed groove 216. Disposed at a distal end of the tubular wall 230 is a sealing end 232 which defines an annular recess 234 along its outer surface. The tubular wall 230 generally extends between the cap 212 and the sealing end 232. The tubular wall 230 has a hollow interior defined by a circumferential interior surface 236 and an interior end wall 238. The interior end wall 238 faces the sealing end 232. The hollow interior is accessible from the sealing end 232. Defined proximate the sealing end 232 of the tubular wall 230 is a plunger inlet 228. The plunger inlet 228 is preferably in the form of an aperture extending through the tubular wall 230.

The pump cylinder 240 is generally in the shape of a right cylinder having two open ends and a unique sidewall configuration, with an interiorly disposed air transfer tube. Specifically, the cylinder 240 includes a head end 242, a nozzle end 270, and a generally cylindrical sidewall 246 extending therebetween. The head end 242 defines two apertures 250 and 262 which provide access to hollow passages defined within the sidewall 246. The cylinder 240 also includes a base 272 proximate the nozzle end 270. The inside of the cylinder 240 is generally hollow and is defined by an interior circumferential surface 290 which is the inner surface of the sidewall 246. The sidewall 246 also defines an exterior surface, opposite from the interior surface 290. The hollow interior of the cylinder 240 is also defined by an end wall 292 proximate the base 272.

Disposed within the hollow interior of the cylinder 240 is an air transfer tube 280. The air transfer tube provides communication between the interior of the cylinder 240 and the nozzle end 270 of the cylinder 240. Preferably, the tube 280 is concentrically positioned within the center of the interior of the cylinder 240. The air transfer tube 280 is also hollow and is supported by and affixed to the base 272 of the cylinder 240 generally along the end wall 292 of the cylinder 240. The air transfer tube 280 preferably extends parallel and co-linearly with the longitudinal axis of the cylinder 240. The air transfer tube 280 defines a first aperture 282 preferably near the head end 242, and a second aperture 284, preferably near the endwall 292 of the cylinder base 272. The first and second apertures 282 and 284, respectively, are preferably in the form of apertures extending through the sidewall of the air transfer tube 280. Also disposed within the air transfer tube 280 and between the first and second apertures 282, 284, respectively, is a one-way valve 286. The one-way valve 286 only permits flow of air from the first aperture 282 to the second aperture 284.

The base 272 of the cylinder 240 defines a discharge passage 274. The passage 274 generally extends from the air transfer tube 280 to the nozzle end 270 of the cylinder 240. And so, the discharge passage 274 provides communication between the interior of the cylinder 240 and the interior of the sport ball.

As noted, the sidewall 246 of the cylinder 240 features a unique passageway configuration. An intake, i.e., "Chamber A" intake 248, is provided by a first sidewall passage 252 extending between the first head aperture 250 and a first sidewall aperture 254. The first sidewall aperture 254 is defined near the base 272 of the cylinder 240. A one-way valve 255 is fitted over the aperture 254 that only allows air to flow into the interior of the pump cylinder 240. It will be appreciated that although valve 255 is depicted schematically in FIG. 5, preferably that valve is a one-way valve as described herein.

A further intake, i.e., "Chamber B" intake 260, is provided by a second sidewall passage 264 extending between the second head aperture 262 and a second sidewall aperture 266. A one-way valve 267 is disposed over the aperture 266 to only allow air to flow into the interior of the pump cylinder 240. As with valve 255, it will be appreciated that although valve 267 is depicted schematically in FIG. 5, preferably, that valve is a one-way valve as described herein. The function and significance of the Chambers A and B, and their associated intakes, apertures, and passageways are further described below.

Upon assembly of the preferred embodiment dual action pump according to the present invention, the plunger 210 is inserted in the hollow interior of the cylinder 240. Specifically, the plunger 210 is disposed within the annular hollow region defined between the air transfer tube 280 and the interior circumferential surface 290 of the sidewall 246 of the cylinder 240. The plunger 210 is inserted in the cylinder 240 such that the sealing end 232 of the plunger 210 is urged toward the end wall 292 of the cylinder 240.

As shown in FIGS. 6–9, the dual action pump 5 of the present invention comprises two seals referred to herein as a primary seal 300 and a secondary seal 320. The primary and secondary seals, 300 and 320 respectively, function in conjunction with the one-way valve 286 disposed in the air transfer tube 280, to form two pumping chambers designated herein as Chamber A and Chamber B. Chamber A is generally defined as the interior region below the primary seal 300 and Chamber B is generally defined as the interior region above the primary seal 300. Before further describing Chambers A and B, it is instructive to further describe the primary and secondary seals 300 and 320.

The primary seal 300 is preferably provided by an O-ring 302 disposed within the annular recess 234 defined along the sealing end 232 of the plunger 210. The O-ring 302 is disposed within the annular region between the sealing end 232 of the plunger 210 and the interior circumferential surface 290 of the pump cylinder 240. As will be appreciated, as the plunger 210 is moved relative to the pump cylinder 240, as described in greater detail herein, the primary seal 300 and specifically, the O-ring 302, provides an air-tight seal between Chamber A below the seal 300 and Chamber B above the seal 300. As the plunger 210 is moved along the length of the pump cylinder 240, the O-ring 302 is carried along with the sealing end 232 of the plunger while maintaining sealing contact with the interior circumferential surface 290 of the pump cylinder 240. A sealing member 301 is also preferably provided between the sealing end 232 and the outer surface of the air transfer tube 280.

Although the embodiments described herein refer to an O-ring such as O-ring 302 for certain seals, it will be appreciated that other types of seals may be utilized. For example, a seal having a non-circular cross-section may be used. Of these, representative examples include, but are not limited to, loaded lip seals and U-cup type seals.

The secondary seal 320 is preferably provided by an assembly of sealing members that extend within the annular region between the air transfer tube 280 and the interior circumferential surface 290 of the pump cylinder 240. The assembly of sealing members include an upper sealing member 322 and a lower sealing member 324. The lower sealing member 324 is preferably disposed between the upper member 322 and the end wall 292 of the pump cylinder 240. The secondary seal 320 operates by temporarily providing an air-tight seal between the region below it, i.e. the region defined between the lower sealing member 324 and the end wall 292, and the region above the secondary seal 320. The secondary seal 320 is configured to only provide this seal as the plunger 210 is withdrawn or pulled out from the pump cylinder 240. Upon movement of the plunger 210 in an opposite direction, i.e. when inserted or pushed into the pump cylinder 240 toward the end wall 292, the secondary seal 320 allows passage of air between the regions above and below the seal 320.

The preferred dual action pump 5 according to the present invention also includes additional sealing members such as an inner annular seal 330 and an outer annular seal 332. Preferably, each of the seals 330 and 332 are in the form of O-rings. The inner annular seal 330 is disposed at the distal end of the air transfer tube 280. The inner annular seal 330 is generally seated around the perimeter of the tube 280 and extends between the outer surface of the tube 280 and the circumferential interior surface 236 of the plunger 210. The inner annular seal 330 prevents passage of air between the regions above and below the seal 330. As the plunger 210 is moved relative to the cylinder 240, the inner annular seal 330 generally maintains its position at the distal end of the air transfer tube 280.

The outer annular seal 332 is generally seated around the perimeter of the plunger 210 and the interior circumferential surface 290 of the pump cylinder 240. The outer annular seal 332 prevents passage of air between the regions above and below the seal 332. As the plunger 210 is moved relative to the cylinder 240, the outer annular seal 332 generally maintains its position proximate the head end 242 of the cylinder 240.

The inner and outer annular seals 330 and 332, in addition to performing the noted sealing functions, also serve to maintain alignment of the plunger 210 with respect to the pump cylinder 240. That is, the seals 330 and 332 promote alignment between the plunger 210 and the cylinder 240, and preferably, ensure that the longitudinal axis of the plunger 210 is not only parallel with the longitudinal axis of the cylinder 240, but also that these two axes are co-linear with each other. Furthermore, the seals 330 and 332 not only promote the noted alignment between the plunger 210 and the cylinder 240, but also ensure that this alignment is maintained during movement of the plunger 210 relative to the cylinder 240.

In a preferred embodiment of the pump, a spring (not shown) is provided within the pump to urge the plunger 210 up and away from the nozzle end 270 of the cylinder 240. The plunger may optionally contain a pressure-indicating device (not shown), such as a ball or slide, and pressure indication lines, and/or a pressure relief mechanism to reduce the pressure of the ball.

Generally, the operation of the preferred dual action pump 5 is as follows. When the plunger 210 is pulled up or out (reverse stroke) from the cylinder 240, the secondary seal 320 is closed, and the valve 255 for Chamber A is open, allowing air to fill Chamber A. When the plunger 210 is pushed in or down (forward stroke) with respect to the cylinder 240, the secondary seal 320 opens, the valve 255 closes, and the one-way valve 286 opens to allow air from Chamber B to enter the ball through the aperture 284 and then through the nozzle end 270. While the air in Chamber B is being forced into the ball, the Chamber A is drawing in air from outside the pump. As the piston is pushed back in, the air in the Chamber A enters the ball by the action of the piston while Chamber B fills with air again. This process is repeated until the desired amount of air has been added to the ball. With each stroke, both in and out, air is forced into the ball.

Unlike a typical single action pump where the seal between plunger and cylinder only forms a seal in one direction, the primary seal 300 of the preferred dual action pump 5 seals the Chambers A and B in both stroke directions. This allows the air in Chamber A to be forced into the ball during the down or forward stroke while preventing the air from escaping. The seal provided by seal 300 also allows the air that is drawn into Chamber B to be forced into the air transfer tube 280 and then into the ball during the up or reverse stroke while the Chamber A refills with air through the Chamber A intake 248.

Figure 6:
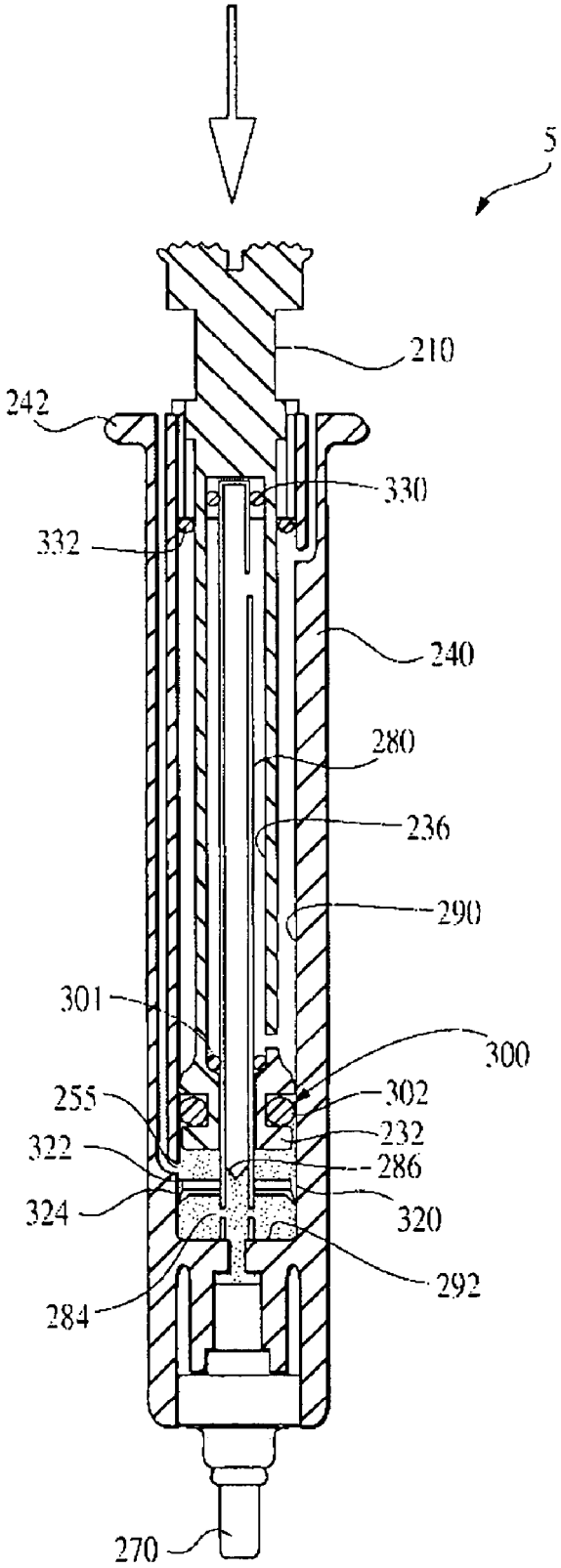
FIG. 6 is a cross section of a preferred dual action pump according to the present invention illustrating air flow within a first chamber of the pump during a forward stroke.
Figure 7:
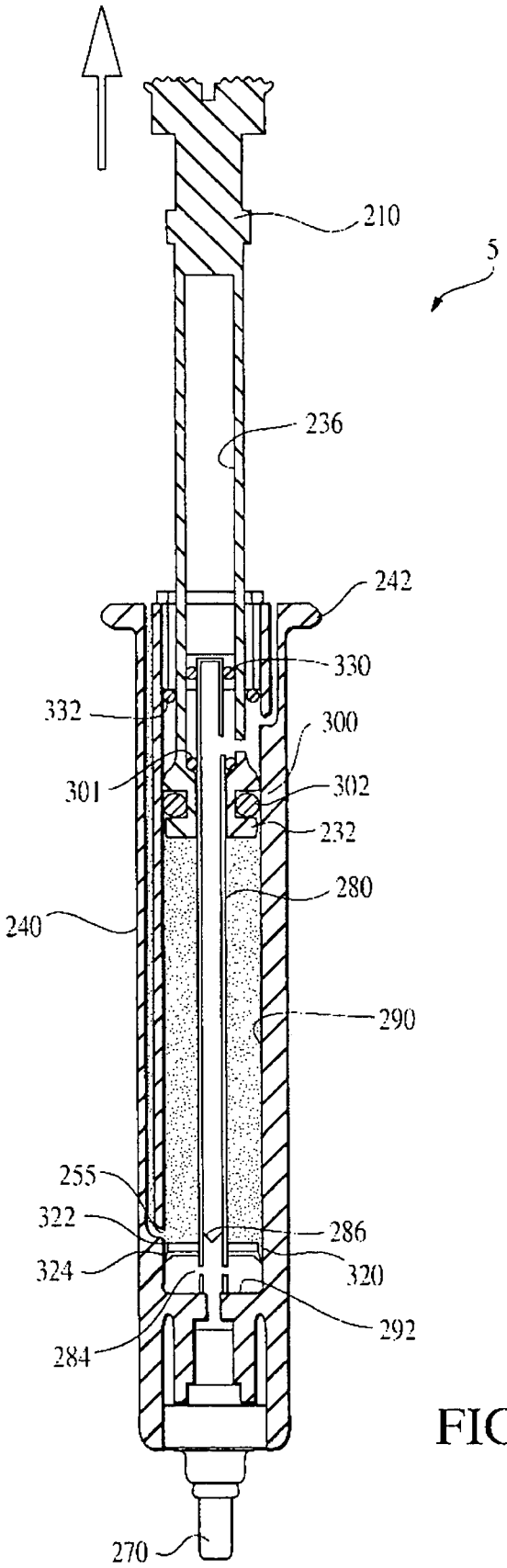
FIG. 7 is a cross section of the preferred dual action pump illustrating air flow within the first chamber during a reverse stroke.
Figure 8:
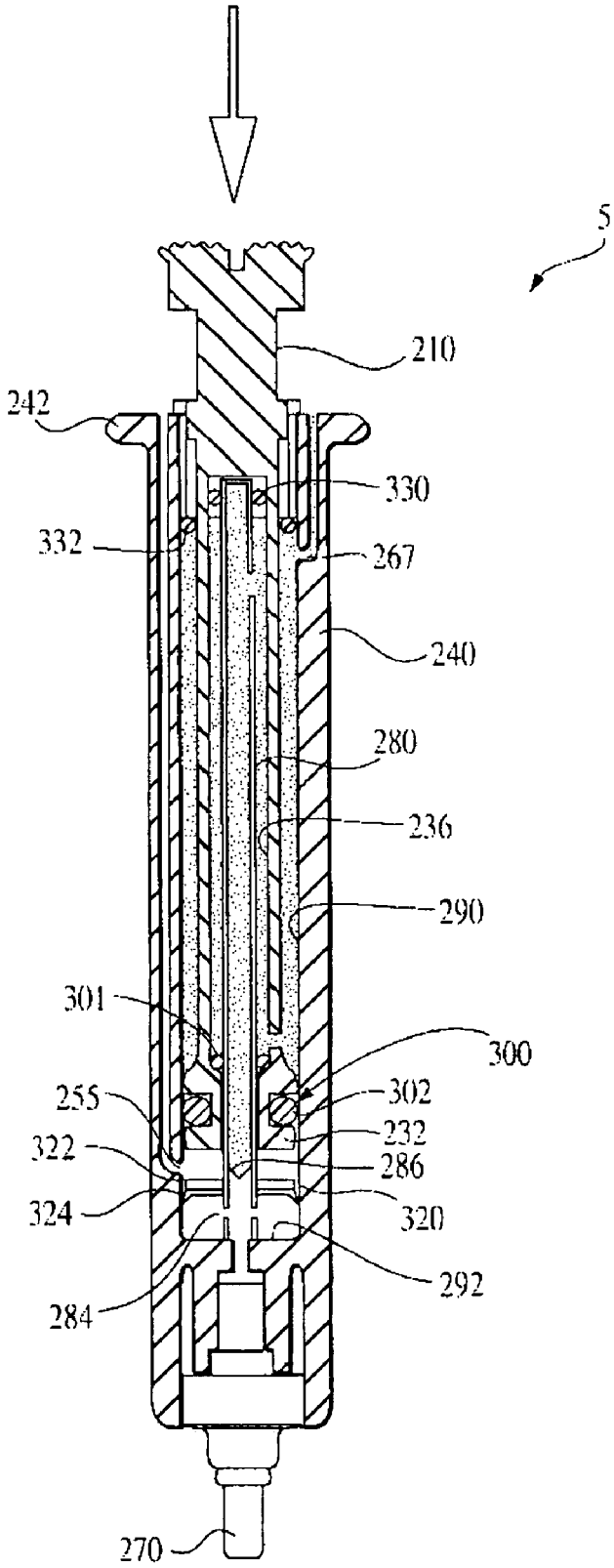
FIG. 8 is a cross section of the preferred dual action pump illustrating air flow within a second chamber during a forward stroke.
Figure 9:
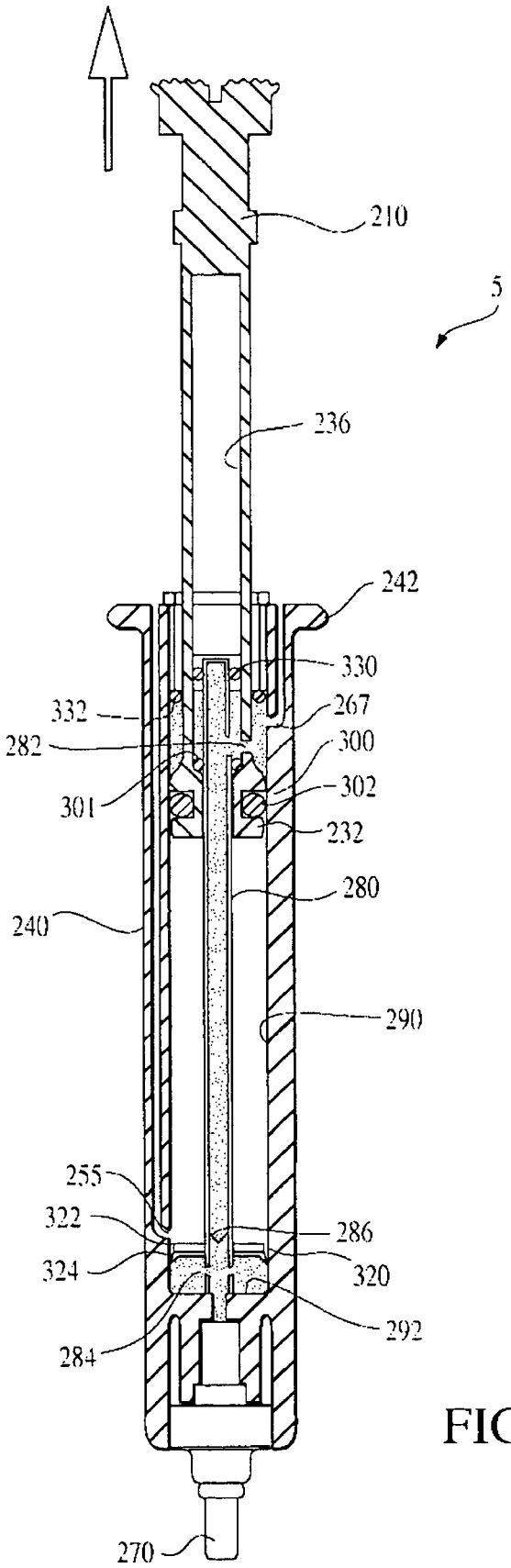
FIG. 9 is a cross section of the preferred dual action pump illustrating air flow within the second chamber during a reverse stroke.

More specifically, the operation of the preferred dual action pump 5 is explained as follows with reference to FIGS. 6–9. FIGS. 6 and 7 primarily illustrate the action of the pump with regard to Chamber A below the primary seal 300 during a forward and reverse stroke, respectively. FIGS. 8 and 9 primarily illustrate the action of the pump with regard to Chamber B above the primary seal 300 during a forward and reverse stroke, respectively.

As shown in FIG. 6, as the plunger 210 undergoes a forward stroke, air residing in Chamber A, denoted by the stippled region in FIG. 6, is compressed and urged to flow through the nozzle end 270 into the ball. This occurs since upon compression of the air within Chamber A, the one-way valve 255 closes thereby preventing escape of air from Chamber A into the Chamber A intake 248. Concurrently with the compression occurring within Chamber A, the secondary seal 320 opens to allow passage of air from the upper portion of Chamber A, i.e. between the sealing end 232 of the plunger 210 and the upper sealing member 322, to the lower portion of Chamber A, i.e. between the lower sealing member 324 and the end wall 292. Concurrently with the compression occurring within Chamber A, the one-way valve 286 disposed within the air transfer tube 280 closes to prevent passage of air within the tube 280. As the plunger 210 undergoes its forward stroke, the increase in pressure within Chamber A causes air flow from that chamber past the secondary seal 322, through the aperture 284 defined in the air transfer tube 280, and through the nozzle end 270 and into the ball undergoing inflation.

FIG. 7 illustrates plunger 210 undergoing a reverse stroke. Upon movement of the sealing end 232 of the plunger 210 away from the secondary seal 320, the volume of Chamber A is increased, thereby reducing the pressure therein. The stippled region in FIG. 7 represents Chamber A. Such pressure change opens the one-way valve 255 of the Chamber A intake 248. This action draws air through the Chamber A intake defined by the first head aperture 250, the first sidewall aperture 254, and the first sidewall passage 252 extending therebetween (see FIG. 5). Concurrently with the reverse stroke of the plunger 210, the secondary seal 320 closes which prevents air withdrawal from the lower portion of Chamber A or from the ball via the nozzle end 270.

FIG. 8 shows the plunger 210 undergoing a forward stroke. During movement of the sealing end 232 and primary seal 300 of the plunger 210 towards the secondary seal 320, the volume of Chamber B, i.e. the interior region above the primary seal 300, increases. The stippled region in FIG. 8 denotes Chamber B. Such volume increase results in a pressure decrease within that chamber and opens the one-way valve 267 disposed at the second sidewall aperture 266 of the Chamber B intake 260 (see FIG. 5). Opening of the valve 267 draws air through the Chamber B intake into the Chamber B defined generally between the outer annular seal 332 and the primary seal 300. Upon the plunger 210 undergoing a forward stroke, the operation of the secondary seal 320 and the one-way valve 286 of the air transfer tube 280 are as previously described with regard to FIG. 6.

FIG. 9 illustrates the change in Chamber B during a reverse stroke of the plunger 210. The stippled region in FIG. 9 illustrates Chamber B. Upon withdrawal of the plunger 210, the contents of Chamber B increase in pressure thereby closing the one-way valve 267. The increase in pressure within Chamber B causes air flow from Chamber B through the first aperture 282 defined at the distal end of the air transfer tube 280, downward through the tube 280, through the now open one-way valve 286, and into the ball through the nozzle end 270. Upon the plunger 210 undergoing a reverse stroke, the operation of the secondary seal 320 is as previously described with regard to FIG. 7.

Figure 10:
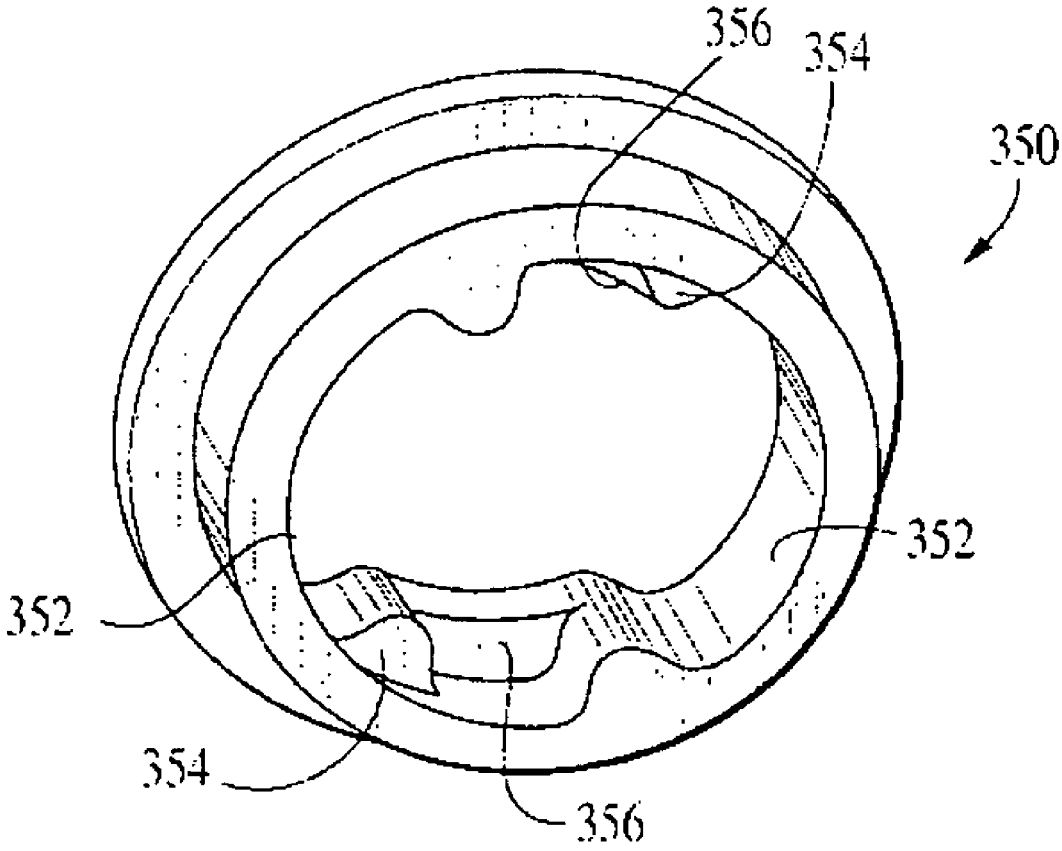
FIG. 10 is a perspective view of a preferred cylinder cap used for securing the dual action pump within a game ball.
Figure 11:
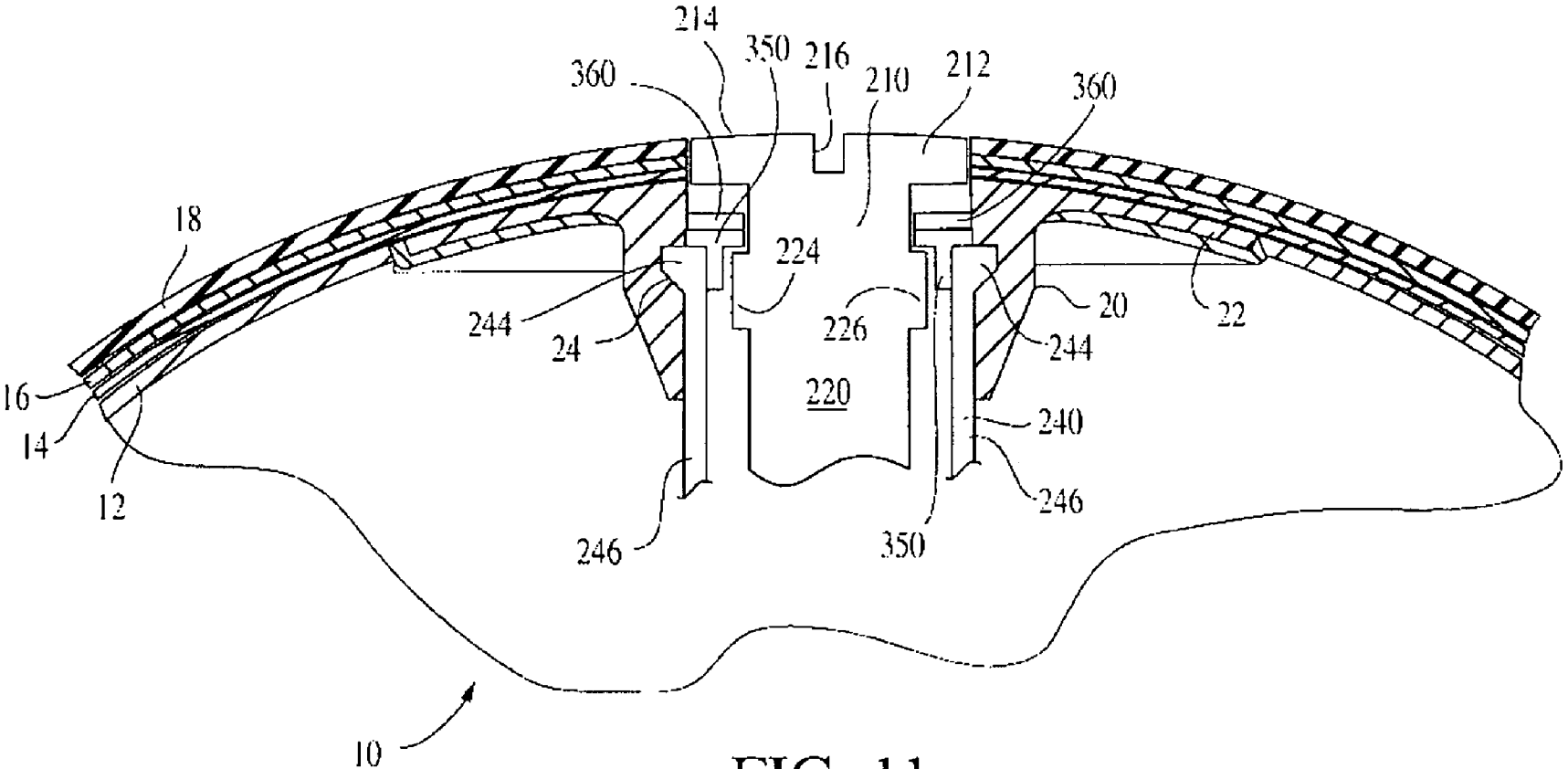
FIG. 11 is a partial cross section of a game ball illustrating the mounting configuration between the dual action pump, the cylinder cap, and a boot.

As best shown in FIGS. 4 and 11, preferably, disposed near the distal end of the plunger 210 are two outwardly extending flanges 224 and 226 that cooperate with a cylinder cap 350 to hold the plunger 210 within sidewalls 246 of the cylinder 240, and to release the plunger 210 for pumping. The cylinder cap 350 is depicted in FIGS. 10 and 11. The cylinder cap 350 is secured to the distal end of the cylinder 240. The plunger 210 extends through the center of the cylinder cap 350. The cap 350 is preferably cemented into the cylinder 240 using a suitable adhesive, such as a UV cured adhesive. FIG. 10 shows an isometric view of the bottom of the cylinder cap 350 and illustrates open areas 352 on opposite sides of the central opening through which the two flanges 224 and 226 of the plunger 210 can pass in the unlocked position. In the locked position, the plunger 210 is pushed down and rotated such that the two flanges 224 and 226 pass under projections 354 and are rotated into locking recesses 356.

As shown in FIGS. 4 and 11, attached to the upper end of the plunger 210 is the cap 212 that is designed to essentially completely fill the hole or aperture in the carcass. In some embodiments, such as a basketball or football, the button or cap 212 is preferably flush or essentially flush with the surface of the ball. In other embodiments, such as a soccer ball, the button or cap 212 is preferably positioned below the surface of the ball. This button 212 may be of any desired material. Examples of materials suitable for use as the button or cap 212 include urethane rubber, butyl rubber, natural rubber or any other material known in the art. A preferred rubber for use as the button or cap is a thermoplastic vulcanizate such as SANTOPRENE™ rubber, available from Advanced Elastomer Systems, Akron, Ohio. The button or cap should match the texture or feel of the outer surface of the ball. The surface of the button or cap may be textured to increase gripping characteristics if desired, such as for a basketball. For a soccer ball, the surface may be smooth.

In a preferred embodiment, fibers or other reinforcing materials for the cap may be incorporated into the rubber compound or thermoplastic material during mixing. Examples of fibers materials suitable for use include, but are not limited to, polyester, polyamide, polypropylene, Kevlar, cellulistic, glass and combinations thereof. Incorporation of fibers or other reinforcing materials into the button or cap improves the durability of the button and improves the union of the button or cap and the piston rod, thus preventing the button or cap from shearing off during use. Although the pump would still function without the button, it becomes very difficult to use.

Preferably, the button or cap 212 is co-injected with the plunger 210 as one part. Alternatively, the button or cap 212 may be co-injected with a connecting piece, and the button or cap 212 and connecting piece may then be attached to the upper end of the plunger 210 using an adhesive suitable for bonding the two pieces together. Co-injecting the button 212 and the plunger 210 as one part, or alternatively, the button 212 and the connecting piece as one part that is mounted to the plunger 210, provides a more durable part that is less likely to break or come apart during routine use of the ball. The button or cap material and the plunger material need to be selected such that the two materials will adhere when co-injected. Testing of various combinations has shown that co-injecting or extruding a soft rubber button, such as a button comprising SANTOPRENE™, and a harder plunger, such as polycarbonate or polypropylene and the like, provides a durable bond without the need for adhesives.

The plunger 210 and the connecting piece may be formed of any suitable material, such as, but not limited to, polycarbonate (PC), polystyrene (PS), acrylic (PMMA), acrylonitrile-styrene acrylate (ASA), polyethylene terephthalate (PET), acrylonitrile-butadiene styrene (ABS) copolymer, ABS;/PC blends, polypropylene (preferably high impact polypropylene), polyphenylene oxide, nylon, combinations thereof, or any suitable material known in the art. Materials with high impact strength are preferred. The material used for the plunger is preferably clear or transparent, especially if a pressure-indicating device is used so that the user can view it.

Referring further to FIG. 11, mounted on the upper surface of the cylinder cap 350 is a pad 360 that is engaged by the button 212 when the plunger 210 is pushed down to lock or unlock the plunger 210. The pad 360 provides cushioning to the pump. The outer face 214 of the button or cap 212 may be textured or smooth to match the feel of the ball, as desired. For basketballs, it is preferable that the top of the button or cap is textured, while for other sport balls, such as soccer balls and footballs, the top of the button is preferably smooth.

Figure 12:
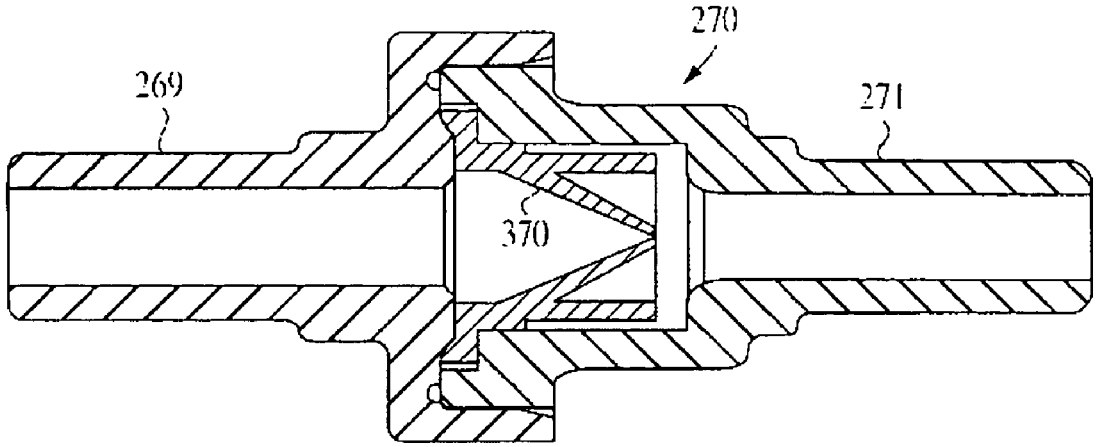
FIG. 12 is a cross section of a preferred nozzle component for use in the dual action pump of the present invention.
Figure 13:
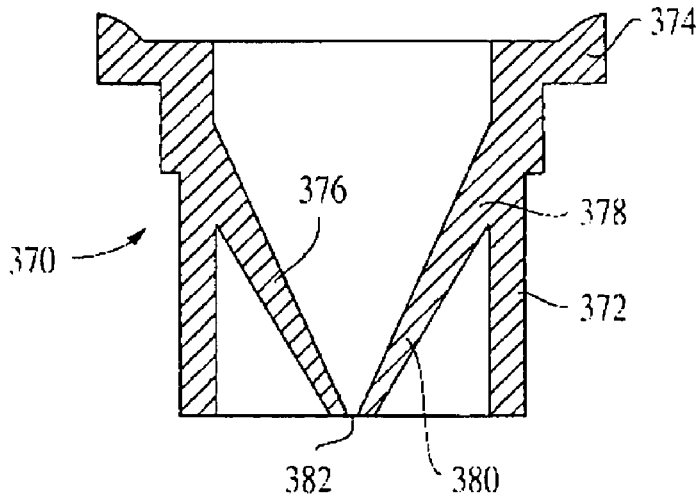
FIG. 13 is a cross section of a preferred duckbill valve used in the nozzle component illustrated in FIG. 12.

FIGS. 6–9 of the drawings show the nozzle end 270 of the pump 5. FIG. 12 is a detailed cross section of that component. Shown in FIG. 12 is one preferred embodiment of a one-way valve assembly of the duckbill-type that is disposed in the nozzle 270. This assembly comprises an inlet end piece 269, an outlet end piece 271 and an elastomeric duckbill valve 370 captured between the two end pieces. The end pieces 269 and 271 are preferably plastic, such as a polycarbonate, polypropylene, nylon, polyethylene, or combinations thereof, but may be any material suitable for use. The end pieces may be ultrasonically welded together. Although any desired one-way valve can be used on the exit nozzle 270 and although duckbill valves are a common type of one-way valves, a specific duckbill configuration is shown in FIG. 13. The duckbill valve 370 is preferably formed of an elastomeric silicone material and is molded with a cylindrical barrel 372 having a flange 374. Inside of the barrel 372 is the duckbill 376 which has an upper inlet end 378 molded around the inside circumference into the barrel 372. The walls or sides 380 of the duckbill 376 taper down to form the straight-line lower end with the duckbill slit 382. The duckbill functions wherein inlet air pressure forces the duckbill slit 382 open to admit air while the air pressure inside of the ball squeezes the duckbill slit closed to prevent the leakage of air. Such a duckbill structure is commercially available from Vernay Laboratories, Inc. of Yellow Springs, Ohio. Any type of one-way valve or other valve capable of sealing known in the art may be used, as long as it prevents air from flowing out of the interior of the ball when not desired.

Figure 14:
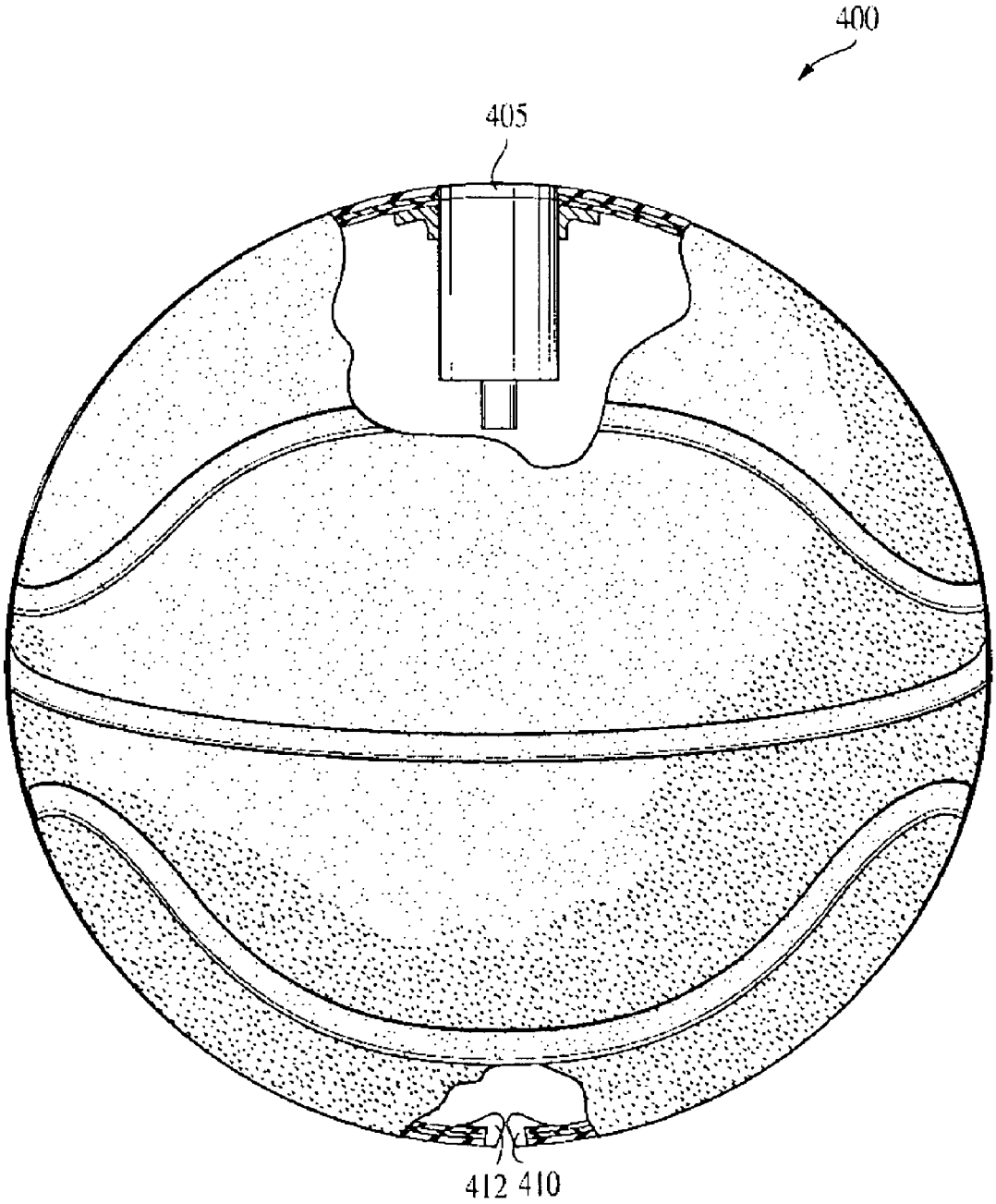
FIG. 14 is another preferred embodiment of a game ball according to the present invention.

A pump assembly of the type described and illustrated herein is preferably made primarily from plastics such as polystyrene, polyethylene, nylon, polycarbonate and combinations thereof, but it can be made of any appropriate material known in the art. Although the assembly is small and light weight, perhaps only about 5 to about 25 grams, a weight may optionally be added to the ball structure to counterbalance the weight of the pump mechanism. In such an application, the weight, i.e. the counterweight, is positioned on or within the ball, and has a suitable mass, such that the resulting center of mass of the ball coincides with the geometric center of the ball. In lighter weight or smaller balls, such as a soccer ball, the pump assembly may weigh less and/or be smaller (shorter) than a corresponding pump assembly for a heavier ball, such as a basketball. FIG. 14 illustrates such a counterbalance arrangement wherein a pump mechanism generally designated as 405 is on one side of the ball and a standard needle valve 410 is on the opposite side of a ball 400. In this case, the material 412 forming the needle valve 410 is weighted. Additional material can be added to the needle valve housing or the region surrounding the valve. Alternatively, a dense metal powder such as tungsten could be added to the rubber compound. The use of another pump or inflation valve is referred to herein as a secondary pump or inflation valve.

The description thus far and the referenced drawings disclose a particular and preferred pump configuration. However, other pump arrangements can be used within the scope of the invention, as long as they utilize at least two chambers to provide for dual action. Examples of other pump arrangements that may be used with the invention are shown in co-pending application Ser. Nos. 09/594,980, filed Jun. 15, 2000; Ser. No. 09/594,547, filed Jun. 14, 2000; 09/594,180, filed Jun. 14, 2000; and 09/560,768, filed Apr. 28, 2000, incorporated herein by reference. Additional details and features that may be implemented in conjunction with the balls and pumps described herein are provided in U.S. Application publication No. U.S. 2002/0187866, filed as Ser. No. 10/183,337 on Jun. 25, 2002; U.S. Pat. No. 6,491,595, filed as Ser. No. 09/712,116 on Nov. 14, 2000; and U.S. Pat. No. 6,287,225 filed as Ser. No. 09/478,225 on Jan. 6, 2000, all of which are hereby incorporated by reference.

Since the pressure in a sport ball can be too high through overinflation or a temperature increase, or too low through underinflation or air loss, it is an advantage to have a pressure-indicating device that is integral to the pump. If the pressure is too low, additional air may be added using the self-contained pump of the invention. If the pressure is too high, the pressure may be relieved by bleeding pressure from the ball with the conventional inflating needle or other implement that will open the conventional inflation valve to release air. Alternatively, the pump may have a mechanism that allows the pressure to be relieved, either through action of the pump, or through the use of a relief mechanism built into the pump, such as a mechanism to open the one-way valve if desired to allow air to flow out of the interior of the ball. The pressure-indicating device of the present invention may then be used to determine if the ball is correctly inflated. If too much air is removed, additional air may be added using the pump.

The foregoing description is, at present, considered to be the preferred embodiments of the present invention. However, it is contemplated that various changes and modifications apparent to those skilled in the art may be made without departing from the present invention. Therefore, the foregoing description is intended to cover all such changes and modifications encompassed within the spirit and scope of the present invention, including all equivalent aspects.

What is claimed is:

1. A sport ball having an integral pump, said ball comprising:

a flexible ball body adapted to retain pressurized air, said body defining an aperture;

a pump disposed in said aperture and retained within said ball body, said pump including (i) a cylinder, (ii) a piston disposed in said cylinder, said piston movable between an extended position and an inserted position, and (iii) a valve assembly configured to introduce air into said ball body upon movement of said piston from said extended position to said inserted position, and to also introduce air into said ball body upon movement of said piston from said inserted position to said extended position.

2. The sport ball of claim 1 wherein said sport ball is a basketball.

3. The sport ball of claim 1 wherein said sport ball is a football.

4. The sport ball of claim 1, said ball further comprises a second integral pump.

5. An inflatable ball having an integral dual action pump assembly for changing air pressure within said ball, said ball comprising:

a rubber bladder defining an interior region adapted for retaining pressurized air;

an outer layer disposed about said rubber bladder; and a pump assembly disposed in said interior region of said rubber bladder, said pump assembly including a movable plunger sealingly disposed within a cylinder secured to said rubber bladder, said plunger movable in both a forward stroke and a reverse stroke, said pump assembly adapted to transfer air to said interior region of said rubber bladder by moving said plunger in either said forward stroke or said reverse stroke, and wherein said plunger has a cap end accessible from said outer layer of said ball, a sealing end disposed within said cylinder, and a tubular wall extending between said cap end and said sealing end.

6. The ball of claim 5 wherein said cylinder has a head end secured to said rubber bladder, a nozzle end disposed in said interior region of said rubber bladder, and a cylindrical sidewall extending between said head end and said nozzle end, said cylinder defining an interior hollow chamber accessible from said head end and extending between an interior circumferential surface of said cylindrical sidewall and an interior end wall disposed adjacent said nozzle end and directed toward said head end.

7. The ball of claim 6 further including an air transfer tube disposed within said interior hollow chamber of said cylinder and extending from said interior end wall towards said head end.

8. The ball of claim 7 wherein said plunger defines an interior hollow region accessible from said sealing end of said plunger, said plunger being positioned and disposed within said hollow chamber of said cylinder such that said air transfer tube is disposed in said interior hollow region of said plunger.

9. The ball of claim 5 wherein said ball is selected from the group consisting of a basketball, a football, a soccer ball, and a volleyball.

10. The ball of claim 9 wherein said ball is a basketball.

11. The ball of claim 9 wherein said ball is a football.

12. The ball of claim 5 wherein said ball further comprises a counterweight positioned on said ball and of a suitable mass such that the center of mass of said ball coincides with the geometric center of said ball.

13. The ball of claim 5 further comprising:

a secondary inflation valve.

14. The sport ball of claim 5, said ball further comprising a second integral pump.

15. An inflatable sport ball having an integral dual action pump assembly for changing air pressure within said ball, said ball comprising:

a ball carcass defining an interior region for retaining air at a pressure greater than atmospheric pressure, said carcass defining an aperture between said interior region and the exterior of said ball;

a pump assembly disposed within said aperture and extending into said interior region, said pump assembly comprising: (i) a pump cylinder including an open end, a nozzle end, and a cylindrical sidewall extending between said open end and said nozzle end, said cylinder defining a generally hollow interior; and (ii) a pump plunger having a cap end, a sealing end, and a tubular wall extending between said cap end and said sealing end, said plunger defining a generally hollow interior accessible from said sealing end, said plunger movably disposed within said hollow interior of said cylinder between a forward position at which said sealing end of said plunger is proximate said nozzle end of said cylinder and a reverse position at which said sealing end of said plunger is proximate said open end of said cylinder; wherein air is transferred to said interior region of said ball carcass upon movement of said plunger (i) from said forward position to said reverse position, or (ii) from said reverse position to said forward position.

16. The sport ball of claim 15 wherein said generally hollow interior of said pump cylinder is defined by an interior end wall proximate said nozzle end and an interior circumferential surface defined by said cylindrical sidewall, said pump cylinder further including an air transfer tube extending within said hollow interior of said pump cylinder and providing communication between said nozzle end of said cylinder and said hollow interior of said cylinder.

17. The sport ball of claim 16 wherein said air transfer tube is concentrically disposed within the hollow interior of said cylinder.

18. The sport ball of claim 16 wherein said air transfer tube extends parallel with a longitudinal axis of said cylinder.

19. The sport ball of claim 16 wherein said air transfer tube includes a one-way valve disposed within the interior of said air transfer tube, said valve configured to only allow air flow in a direction towards said interior end wall of said cylinder.

20. The sport ball of claim 16 wherein said pump assembly further comprises:

a seal disposed within an annular region of said hollow interior of said cylinder extending between said air transfer tube and said interior circumferential surface defined by said sidewall of said cylinder, said seal configured to only allow air flow in a direction towards said interior end wall of said cylinder.

21. The sport ball of claim 16 wherein said pump cylinder further defines a first intake passage extending within said cylindrical sidewall from a first head aperture defined at said head end of said cylinder, to a first sidewall aperture defined by said interior circumferential surface, said first sidewall aperture defined proximate said interior end wall.

22. The sport ball of claim 21 wherein said pump cylinder further includes a one-way valve in communication with said first sidewall aperture, said valve configured to allow air flow in only a direction into said hollow interior of said cylinder.

23. The sport ball of claim 22 wherein said pump cylinder further defines a second intake passage extending within said cylindrical sidewall from a second head aperture defined at said head end of said cylinder, to a second sidewall aperture defined by said interior circumferential surface, said second sidewall aperture defined proximate said head end of said cylinder.

24. The sport ball of claim 23 wherein said pump cylinder further includes a second one-way valve in communication with said second sidewall aperture, said second valve configured to allow air flow in only a direction into said hollow interior of said cylinder.

25. The sport ball of claim 15 wherein said hollow interior of said pump plunger is defined by an interior end wall proximate said cap end of said plunger and a circumferential interior surface defined by said tubular wall of said plunger, said tubular wall defining a plunger inlet providing communication between said generally hollow interior of said plunger and the exterior of said plunger, said plunger inlet defined between said sealing end and said interior end wall of said plunger.

26. The sport ball of claim 15 further comprising:

a secondary inflation valve.

27. The inflatable sport ball of claim 15, said ball further comprising a second integral dual action pump assembly.

* * * * *